US006598566B2

(12) United States Patent
Yasuda et al.

(10) Patent No.: US 6,598,566 B2
(45) Date of Patent: Jul. 29, 2003

(54) WATER-COOLED OUTBOARD MARINE ENGINE

(75) Inventors: Kouji Yasuda, Wako (JP); Hideaki Takada, Wako (JP); Yoshihiko Fukuda, Wako (JP); Mitsuharu Tanaka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 37 days.

(21) Appl. No.: 09/924,756

(22) Filed: Aug. 7, 2001

(65) Prior Publication Data

US 2002/0020366 A1 Feb. 21, 2002

(30) Foreign Application Priority Data

Aug. 11, 2000 (JP) ..... 2000-244185

(51) Int. Cl.[7] ..... F02B 75/18

(52) U.S. Cl. ..... 123/41.74; 440/88; 440/89; 123/41.08

(58) Field of Search ..... 123/41.74, 41.08; 440/88, 89

(56) References Cited

U.S. PATENT DOCUMENTS 3,918,418 A * 11/1975 Horn ..... 123/41.08

* cited by examiner

*Primary Examiner*—Henry C. Yuen
*Assistant Examiner*—Katrina B. Harris
(74) *Attorney, Agent, or Firm*—MacPherson Kwok Chen & Heid LLP

(57) ABSTRACT

In a water-cooled outboard marine engine, a heat transfer portion is provided in an exit passage located between an outlet end of a cylinder water jacket and a cooling water outlet passage at a position upstream of the thermostat valve. Thus, when the thermostat valve has opened and the cooling water expelled from the water jacket via the thermostat valve has been replaced by freshly introduced cooling water, the heat transfer portion having a certain heat capacity warms the freshly introduced cooling water so that the rapid change in the cooling water temperature at the thermostat valve and the resulting hunting of the thermostat valve can be avoided.

6 Claims, 3 Drawing Sheets

WATER-COOLED OUTBOARD MARINE ENGINE

TECHNICAL FIELD

The present invention relates to water-cooled marine engines, and in particular to a cooling water passage arrangement suitable for use in relatively small water-cooled outboard marine engines.

BACKGROUND OF THE INVENTION

In a water-cooled internal combustion engine, the cooling water temperature is maintained at a prescribed level by providing a thermostat valve at an exit end of a water jacket formed around a cylinder block. The thermostat valve opens and closes according to the cooling water temperature as well known in the art. In case of an outboard marine engine, it is common to draw cooling water from an inlet port provided in a submerged part of the outboard engine and directly forward it to the water jacket by using a pump.

In such an engine, as soon as the thermostat valve opens as a result of a rise in the cooling water temperature and the high temperature cooling water is expelled, cooler water from the body of water surrounding the watercraft is drawn into the cooling water passage. Particularly if the engine consists of a single or inline two cylinder engine, because the passage for the cooling water for the cylinder block is relatively short, there is a tendency for the cooling water of such a small outboard marine engine to rapidly fluctuate in temperature. In the worst case, the thermostat valve may open and close in short intervals. This is called "hunting", and compromises the proper control of the cooling water.

BRIEF SUMMARY OF THE INVENTION

In view of such problems of the prior art, a primary object of the present invention is to provide an outboard marine engine which avoids such a hunting of the thermostat valve.

A second object of the present invention is to provide an outboard marine engine which is provided with a cooling water passage adapted to ensure a stable cooling water temperature control.

According to the present invention, such objects can be accomplished by providing a cooling water passage arrangement for a water-cooled marine engine, comprising: a cylinder block including a water jacket; a water inlet passage having a first end submerged in a surrounding body of water and a second end communicating with the water jacket; a water pump provided in association with the water inlet passage; a water outlet passage having a first end communicating with the water jacket and a second end communicating with a water outlet port; a thermostat valve provided in an exit passage defined between an outlet end of the water jacket and an inlet end of the water outlet passage; and a heat transfer portion provided in the exit passage upstream of the thermostat valve.

Thus, when the thermostat valve has opened and the cooling water expelled from the water jacket via the thermostat valve has been replaced by freshly introduced cooling water, the heat transfer portion having a certain heat capacity warms the freshly introduced cooling water so that the rapid change in the cooling water temperature at the thermostat valve can be avoided. In particular, by extending the heat transfer portion from a relatively warm part of the engine, it is possible to supply heat to the heat transfer portion so that the temperature stabilizing effect of the heat transfer portion may be maintained even after the heat stored in the heat transfer portion has been expended. For instance, the heat transfer portion may extend directly from a wall member having a threaded hole formed therein for receiving a threaded bolt for securing a cylinder head to the cylinder block.

To enhance favorable transfer of heat to the heat transfer portion and ensure a reasonable amount of heat capacity to the heat transfer portion without unduly increasing the resistance to the flow of the cooling water, the heat transfer portion may extend along a certain distance along a flow direction of the exit passage and across the exit passage. Alternatively, the heat transfer portion may extend along a certain distance along a flow direction of the exit passage and project into the exit passage.

According to a preferred embodiment of the present invention, to simplify the manufacturing process, a mating surface of the cylinder block for a water jacket cover to define a cooling water outlet passage, a mounting surface for the thermostat valve at an outlet end of the exit passage, and a mounting surface for a flush valve are defined by a common machined surface of the cylinder block.

To ensure a favorable access to the thermostat valve and/or flush valve, the common machined surface of the cylinder block may be defined on an outer side of an exhaust passage of the engine with respect to a cylinder of the engine.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
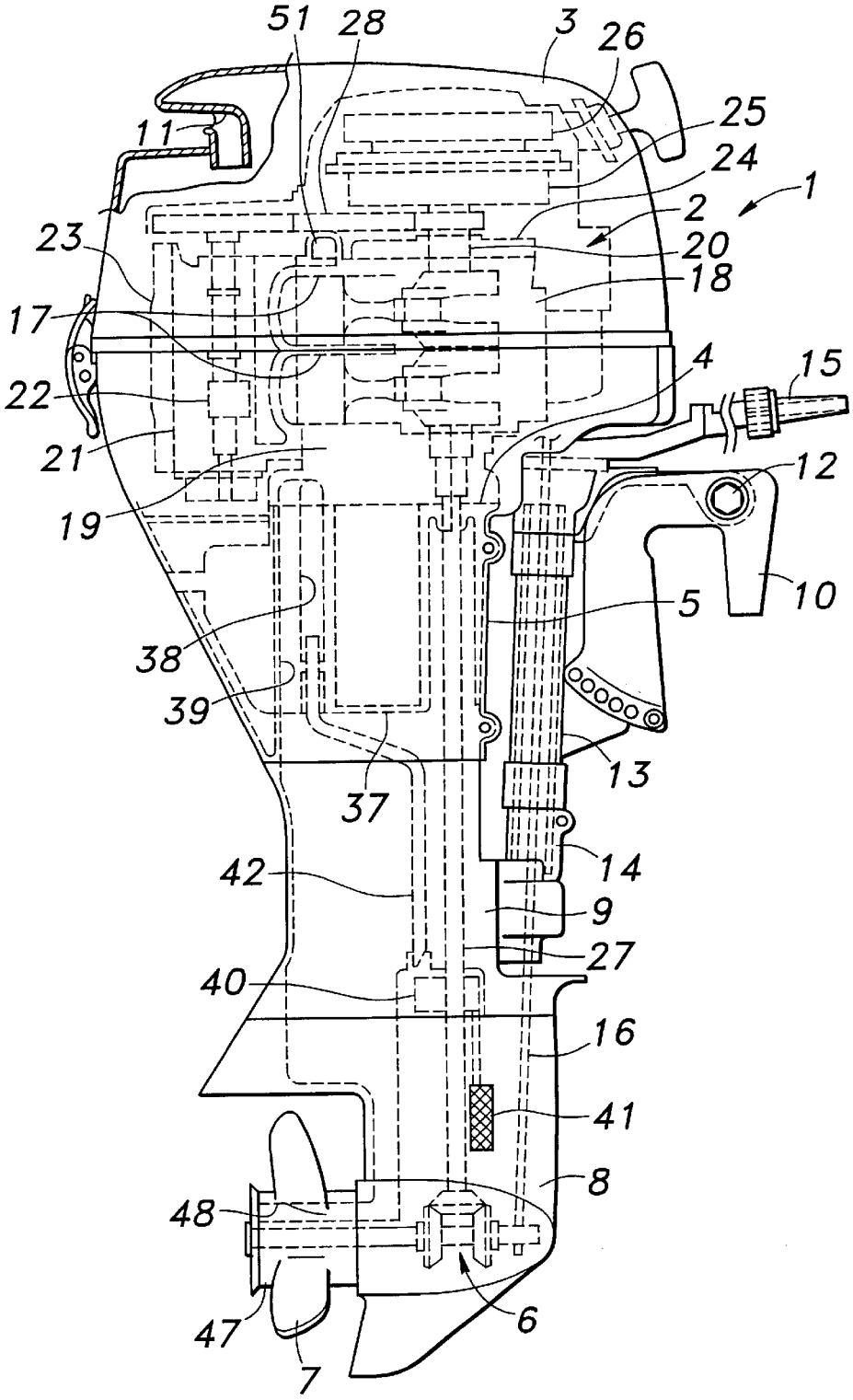
FIG. 1 is a schematic side view of an outboard marine drive incorporated with an internal combustion engine embodying the present invention.

FIG. 1 generally shows an outboard marine drive 1 fitted with a marine engine 2 embodying the present invention. The outboard marine drive 1 comprises an engine cover 3 covering an upper part of the engine 2, an under cover 5 including an engine mount 4, a gear case 8 accommodating a transmission device 6 including a reduction gear unit, clutch and forward/backward select unit and supporting a propeller 7, an extension case 9 connecting the under cover 5 and gear case 8 together, and a stem clamp bracket 10 for securing the outboard marine drive 1 to a stem board of watercraft not shown in the drawing. An intake duct 11 opens out on the engine cover 3.

A tubular swivel case 13 is connected to the stern clamp bracket 10 via a tilt shaft 12, and rotatably supports a swivel shaft 14 having its upper and lower ends connected to the under cover 5 and extension case 9, respectively. By operating a tiller arm 15 attached to the swivel shaft 14, the outboard marine drive 1 can be swiveled with respect to the watercraft about a substantially vertical axis so that a desired steering of the watercraft can be effected. The swivel shaft 14 consists of a hollow shaft, and receives therein a rod 16 for actuating the forward/backward select unit.

The engine 2 consists of a four stroke vertical crankshaft engine, and comprises a cylinder block 19 defining a pair of cylinders 17 and integrally incorporated with a crankcase 18, a crankshaft 20 rotatably supported in the cylinder block 19 in a vertical orientation, a cylinder head 21 which is connected to an end of the cylinder block 19 remote from the crankcase 18 to define combustion chambers and rotatably supports a camshaft 22, and a head cover 23 which defines a valve chamber jointly with the cylinder head 21.

The crankshaft 20 has a lower end which is rotatably supported by a lower bearing wall formed integrally with the cylinder block 19, and an upper end which is rotatably supported by an upper cover 24 attached to the upper wall of the cylinder block 19. To the upper end of the crankshaft 20 are connected a flywheel 25 and recoil starter 26. To the lower end of the crankshaft 20 is connected a drive shaft 27 for transmitting power to the propeller 7. The camshaft 22 is connected to the crankshaft 20 via a belt/pulley mechanism 28.

Figure 2:
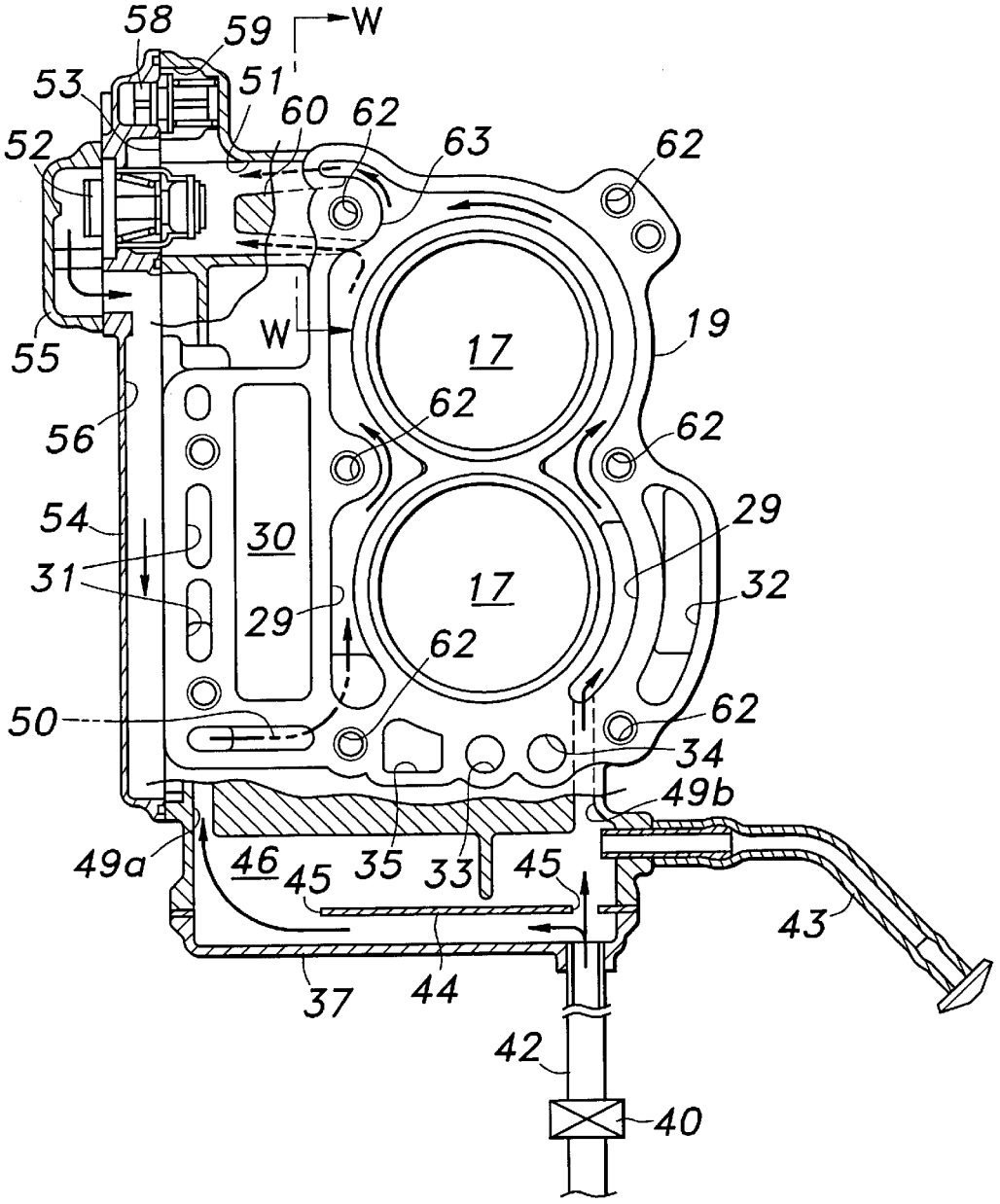
FIG. 2 is a fragmentary partly broken away front view of an end surface of the cylinder block on which the cylinder head is attached.

Referring to FIG. 2, the cylinder block 19 of the engine 2 is provided with a water jacket 29 surrounding the vertically aligned horizontal cylinders 17, an exhaust passage 30 connected to an exhaust port provided in the cylinder head 21, a water jacket 31 for conducting cooling water adjacent to the exhaust passage 30, a breather passage 32 for communicating the crankcase 18 and cylinder head 21 with each other to minimize the fluctuations in the internal pressure of the crankcase 18, an oil input passage 33 leading to a lubricating oil pump (not shown in the drawings) connected to the lower end of the camshaft 22, an oil output passage 34 led out from the lubricating oil pump, and an oil return passage 35 extending from the cylinder head 21.

The lower surface of the cylinder block 19 is connected to an oil case 37 to receive the lubricating oil. A cooling water supply passage 38 and exhaust passage 39 are integrally formed in a part of the oil case 37. The cooling water supply passage 38 is connected to a water feed pipe 42 which has an input end opening out at a water inlet port 41 in an upper part of the gear case 8 and is provided with a water pump 40 driven by a drive shaft connected to the crankshaft 20 in an intermediate part of the cooling water supply passage 38 to draw water from the surrounding body of water via the water inlet port 41, and the cooling water supply passage 38 is also connected to a telltale port 43. The cooling water supply passage 38 on the side of the oil case 37 communicates with a cooling water passage 46 on the side of the cylinder block 19 via an opening 45 formed in a gasket 44 interposed between the cylinder block 19 and oil case 37.

The exhaust passage 39 formed in the oil case 37 is connected to an exhaust passage 30 formed in the cylinder block 19, and the exhaust gas emitted from the engine is passed through the interior of the extension case 9, and is expelled into the surrounding body of water from an exhaust port 48 provided in a propeller boss 47.

The cooling water, drawn by the water pump 40 from the water inlet port 41 which is submerged during the operation of the marine board drive, flows through the water feed pipe 42 extending inside the extension case 9, and reaches the water jacket 29 via the inlet passages 49*a* and 49*b* internally provided in a lower part of the cylinder block 19 and a communication passage 50 internally formed in the cylinder head 21. The cooling water then flows upward in the water jacket 29, and exits the water jacket 29 from an exit passage 51 formed in an upper left side of the cylinder block 19 as seen in the FIG. 2. The exit passage 51 receives a thermostat valve 52 which opens when the temperature of the cooling water in the water jacket 29 exceeds a prescribed level. The cooling water which has passed through the thermostat valve 52 travels downward in a water outlet passage 56 defined by a thermostat cover 55 and between a machined side surface 53 of the cylinder block 19 and a water jacket cover 54, and is eventually expelled from the lower end of the cylinder block 19 into the under cover 5. Similarly, the cooling water which has passed through the water jacket 31 adjacent to the exhaust passage 30 is expelled to the interior of the under cover 5 via a water outlet passage 57 defined between a machined side surface 53 of the cylinder block 19 and water jacket cover 54.

In the illustrated embodiment, the mating surface of the cylinder block 19 for the water jacket cover 54, the opening surface of the exit passage 51 for abutting the flange of the thermostat valve 52 and the opening surface of a flush orifice 59 supporting a flush valve 58 are placed on a common plane (side machined surface 53) so that the machining work may be simplified, and the manufacturing cost may be reduced. The water outlet passages 56 and 57 are placed outside the exhaust passage 30 on one side of the cylinder block 19. Therefore, the access to the thermostat valve 52 is not hindered by the exhaust passage 30 and the replacement or servicing the thermostat 52 is simplified.

In such a structure, the warm cooling water heated in the water jacket 29 and cool cooling water freshly drawn from the surrounding body of water by the water pump 40 may not favorably mix together, and this could cause a hunting of the thermostat valve 52.

Figure 3:
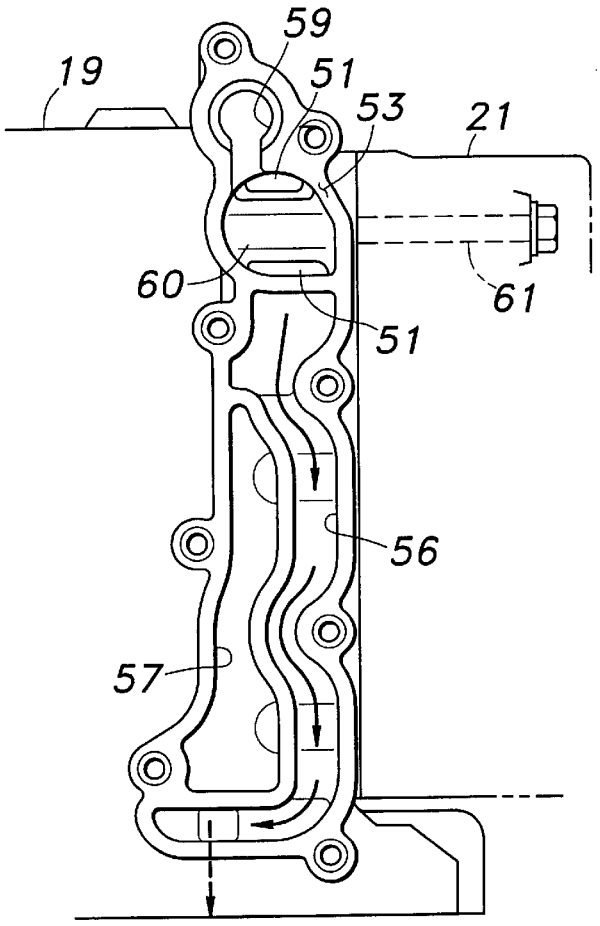
FIG. 3 is a fragmentary side view of a side end surface of the cylinder block.
Figure 4:
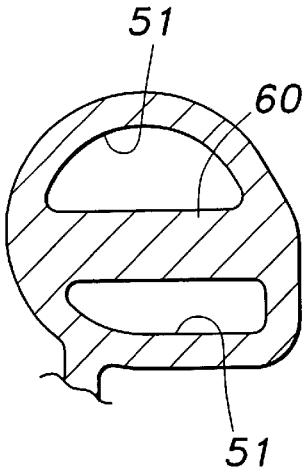
FIG. 4 is a sectional view taken along line IV—IV of FIG. 2.

Therefore, according to the present invention, a heat transfer portion 60 is formed in a part of the cooling water passage downstream of the water jacket 29 and upstream of the thermostat valve 52. Referring to FIGS. 3 and 4, the heat transfer portion 60 in this case consists of an integral extension of the wall of the water jacket 29 which extends a certain distance along the flow of the cooling water in the horizontal direction, and extends midway across the cooling water exit passage 51. The heat transfer portion 60 is connected to a boss 63 for a threaded hole 62 into which one of a number of threaded bolts 61 for securing the cylinder head 21 to the cylinder block 19 is threaded. This arrangement increases the contact area between the cooling water and surrounding wall of the cooling water exit passage 51 and the heat capacity of the surrounding wall without substantially increasing the resistance to the flow of the cooling water.

The heat stored in the heat transfer portion 60 warms the part of the cooling water which is freshly introduced from the surrounding body of water before it contacts the thermostat valve 52, and prevents the thermostat valve 52 from opening due to such the localized effect of the freshly introduced cooling water. This contributes to the elimination of the hunting of the thermostat valve 52.

By connecting the heat transfer portion 60 to the boss 63 for one of the threaded bolts 61 for securing the cylinder head 21 to the cylinder block 19, the heat transfer portion also contributes to the cooling of the part immediately adjacent to the combustion chamber. Thus, not only the action to warm the freshly introduced cooling water is enhanced but also the efficiency of cooling the engine is enhanced because the hottest part of the engine is relatively preferentially cooled.

The heat storing capacity of the heat transfer portion 60 can be adjusted at will by changing the volume of the heat transfer portion 60. In particular, by optimally selecting the volume of the heat transfer portion 60, the excessive cooling of the engine, which is a serious concern in a marine engine which draws the cooling water from the surrounding body of water, can be effectively avoided. Even when the water jacket 29 and thermostat valve 52 are required to be placed remote from each other, the provision of such a heat transfer portion ensures a favorable operation of the thermostat valve 52.

Figure 5:
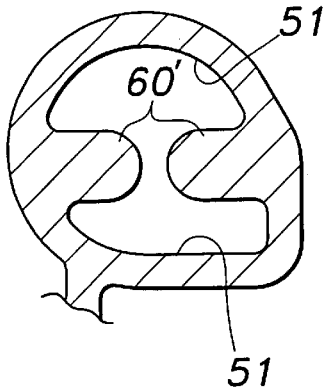
FIG. 5 is a view similar to FIG. 4 showing an alternate embodiment of the present invention.

FIG. 5 shows a second embodiment of the present invention in which the heat transfer portion consists of a pair of projections 60' which extend over a certain length along the flow direction of the cooling water, and project from the opposing wall portions of the exit passage 51 toward each other so as to define a gap between the free ends of the projections 60'. The heat transfer portion can take other forms as long as it can provide an improved heat transfer between the cooling water and a wall portion of the cylinder block. It is preferable that the heat transfer portion has an increased heat capacity so that an improved thermally stabilizing effect may be produced.

Although the present invention has been described in terms of preferred embodiments thereof, it is obvious to a person skilled in the art that various alterations and modifications are possible without departing from the scope of the present invention which is set forth in the appended claims.

What is claimed is:

1. Cooling water passage arrangement for a water-cooled marine engine, comprising:

a cylinder block including a water jacket;

a water inlet passage having a first end submerged in a surrounding body of water and a second end communicating with said water jacket;

a water pump provided in association with said water inlet passage;

a water outlet passage having a first end communicating with said water jacket and a second end communicating with a water outlet port;

a thermostat valve provided in an exit passage defined between an outlet end of said water jacket and an inlet end of said water outlet passage; and a heat transfer portion provided in said exit passage upstream of said thermostat valve.

2. Cooling water passage arrangement according to claim 1, wherein said heat transfer portion extends along a certain distance along a flow direction of said exit passage and across said exit passage.

3. Cooling water passage arrangement according to claim 1, wherein said heat transfer portion extends along a certain distance along a flow direction of said exit passage and projects into said exit passage.

4. Cooling water passage arrangement according to claim 1, wherein said heat transfer portion extends directly from a wall member having a threaded hole formed therein for receiving a threaded bolt for securing a cylinder head to said cylinder block.

5. Cooling water passage arrangement according to claim 1, wherein a mating surface of said cylinder block for a water jacket cover to define a cooling water outlet passage, a mounting surface for said thermostat valve at an outlet end of said exit passage, and a mounting surface for a flush valve are defined by a common machined surface of said cylinder block.

6. Cooling water passage arrangement according to claim 5, wherein said common machined surface of said cylinder block is defined on an outer side of an exhaust passage of said engine with respect to a cylinder of said engine.

* * * * *